US007828163B2

(12) United States Patent
Zollondz et al.

(10) Patent No.: US 7,828,163 B2
(45) Date of Patent: Nov. 9, 2010

(54) LATTICE BOOM CRANE FOR LIFTING HEAVY LOADS

(75) Inventors: Ruediger Zollondz, Hornbach (DE); Alfons Weckbecker, Zweibruecken (DE); Ingo Noeske, Zweibruecken (DE); Guenter Karp, Herschberg (DE)

(73) Assignee: Terex Demag GmbH, Zweibruecken (DE)

( * ) Notice: Subject to any disclaimer, the term of this patent is extended or adjusted under 35 U.S.C. 154(b) by 25 days.

(21) Appl. No.: 11/431,760

(22) Filed: May 10, 2006

(65) Prior Publication Data

US 2006/0273057 A1 Dec. 7, 2006

(30) Foreign Application Priority Data

May 11, 2005 (DE) ..... 10 2005 021 859

(51) Int. Cl.
*B66B 23/78* (2006.01)

(52) U.S. Cl. ..... 212/301; 212/233; 212/271

(58) Field of Classification Search ..... 212/239, 212/262, 301, 233, 271
See application file for complete search history.

(56) References Cited

U.S. PATENT DOCUMENTS 2,421,913 A * 6/1947 Stoddard ..... 52/117
3,868,022 A * 2/1975 Greenlay et al. ..... 212/291
5,018,630 A * 5/1991 McGhie ..... 212/233
6,516,961 B1 2/2003 Knecht et al.

FOREIGN PATENT DOCUMENTS

| | | |
|---|---|---|
| AT | 282876 | 7/1970 |
| DE | 1 531 631 | 1/1970 |
| DE | 27 45 059 | 4/1978 |
| DE | 29 02 767 | 8/1979 |
| DE | 30 26 850 | 2/1981 |
| DE | 195 49 244 | 6/1997 |
| GB | 1162405 | 8/1969 |
| JP | 09 086875 | 3/1997 |
| JP | 2000 086151 | 3/2000 |
| JP | 2001 072379 | 3/2001 |
| SU | 644368 A * | 1/1979 |

* cited by examiner

*Primary Examiner*—Thomas J. Brahan
(74) *Attorney, Agent, or Firm*—Simpson & Simpson, PLLC

(57) ABSTRACT

The invention concerns a lattice boom crane, which is composed of at least two individual lattice boom cranes (1, 11), which each comprise a luffing lattice boom (4, 14), whose luffing angle is adjustable by a luffing mechanism (5, 15). The lattice booms (4, 14) of the individual lattice boom cranes (1, 11) are connected with each other and oriented in parallel and adjacent to each other and the luffing mechanisms (5, 15) of the lattice boom cranes (1, 11) are synchronously operated, such that the rigidly-connected lattice booms (4, 14) are synchronously luffable.

11 Claims, 5 Drawing Sheets

LATTICE BOOM CRANE FOR LIFTING HEAVY LOADS

CROSS REFERENCE TO RELATED APPLICATIONS

This patent application claims priority of German Patent Application Serial No. 10 2005 021 859.8-22 filed May 11, 2005, which application is incorporated herein by reference.

FIELD OF THE INVENTION

The present invention concerns a lattice boom crane for lifting heavy loads, such as, e.g., reactors, generators, distillation columns or the like.

BACKGROUND OF THE INVENTION

Cranes are always designed for a specific ultimate load range. The lifting of heavy ultimate loads is then potentially not possible with such a crane. For lesser loads, such a crane is not economical, because the purchase and operation costs are higher than the costs of a smaller crane. Nevertheless, in order to lift increased loads without having to purchase a larger crane, it is already known to lift a load with multiple cranes simultaneously. However, the necessary safety is ensured only under specifically defined conditions with such so-called tandem or multiple-lifts, as a rule, due to the problematic load distribution or the fact that the crane is equipped with individual controllers. Consequently, the load to be lifted with such tandem or multiple-lifts is often permitted to be only so high that maximally 60 to 80 percent of the load carrying capacity is used.

It is already known from GB 1,162,405A to connect two cranes by a portal, which is affixed to the free ends of each boom, in order to lift heavy loads. The problem with this arrangement is that the position of the two cranes is not fixed relative to each other and thus it results in constraining forces, whereby the load must be reduced.

A double portal crane for bulky loads, in particular a container crane, is known from AT 28 28 76. This double portal crane comprises two separate, movable crane portals. Each crane portal carries a crane trolley, preferably designed as an angled trolley, with its lifting unit. The two crane portals are latchable with each other at specified intervals. The trolleys are independent from each other in a known manner and are also synchronously movable with each other by an operator's stand. According to one exemplary embodiment, one drive train can also comprise only one of the crane portals.

The ring lift crane shown in U.S. Pat. No. 6,516,961 B1 comprises, in one exemplary embodiment, a parallel connection of two lattice booms on a common lower chassis. The booms mutually stabilize each other, whereby the achievable ultimate load amounts to more than twice that of a single boom. In other respects, the crane includes a single basic unit like a usual crane, which unit is designed for the ultimate load of the double boom. It cannot be operated economically with only one boom. Moreover, a ring lift crane is, as a rule, not portable and is consequently severely limited in its work area, because this is possible only with a relatively high technical effort.

A twin slewing crane is described in DE 27 45 059 A1, which finds application especially as a deck crane. The twin slewing crane described therein comprises two cranes disposed the same distance from a common vertical pivot axis. The two cranes each comprise a boom and are individually operable. Both cranes rest on a common foundation that is, e.g., mounted in a ship hull. A sprocket is located on this foundation, which sprocket is part of the slewing gear of the one crane as well as a part of the slewing gear of the other crane.

Lastly, a ring lift crane is disclosed in DE 30 26 850 A1, which crane is also alleged to be portable when loaded.

For the purpose of a comprehensive discussion, a lifting gear, in particular according to the crane type of DE 29 02 767 A1, also should be pointed out. A rotatably-supported main ring is affixed to a self-propelled vehicle or a stationary plane. A horizontal platform is rigidly and fixedly provided on the main ring, which platform takes part in the rotation with the main ring and which projects in a cantilever manner on one side with respect to the main ring. Furthermore, two turret-like, rotatably-borne supports are provided, which supports are borne on the horizontal platform on the par provided with respect to the main ring. Two extendable booms, which are angularly adjustable in arbitrary positions, are provided on the turret-like supports, which booms are operable independently from each other. Similar to the ring lift crane of U.S. Pat. No. 6,516,961 B1, a common chassis is again provided, on which chassis the two independently-operable booms are disposed.

A deck crane device with multiple derrick crane booms, which are rotatable independently of each other, is known from DE 1 531 631 OS. Two of the derrick booms are coupleable with each other and are commonly rotatable about the central axis in the coupled position and are commonly pivotable about horizontal axes. The horizontal pivot axes of the derrick booms are disposed on separate, concentric rim bearings, which are formed as ring-shaped and box-like. At least two derrick booms are operably coupleable with each other in one position near to each other in the vertical and the horizontal planes.

SUMMARY OF THE INVENTION

The technical problem underlying the invention consists in that a lattice boom crane is provided that is suitable on the one hand for the lifting of especially heavy loads and on the other hand is economically usable for the lifting of less heavy loads.

According to a first aspect of the present invention, this problem can be solved by a lattice boom crane that is formed by parallel connection of at least two individual lattice boom cranes. The individual cranes each comprise a base crane, on which a tiltable or luffing lattice boom is disposed. The respective base cranes comprise a lower chassis or undercarriage and a slewing upper chassis that is rotatably affixed on the lower chassis. According to such an inventive lattice boom crane, the lattice booms are connected to each other and the respective individual lattice booms are oriented in parallel and adjacent to each other. The luffing mechanisms of the individual lattice boom cranes are synchronized, such that the at least two lattice booms are synchronously luffable or tiltable.

For the purpose of a comprehensive discussion, it is noted that the term "base unit" and/or "base crane" is a generalized term for the lower part of a crane without the boom that sits on the lower part. Therefore, a base unit and/or base crane comprise(s) a lower chassis, an upper chassis and the rotary joint connecting the lower chassis and the upper chassis. A lower chassis of a base crane can thus comprise wheels or crawlers and/or crawler-tracks for progressive movement. The term "upper chassis" can also be equated with one of the terms "superstructure" or "slewing platform".

One of several basic concepts underlying the present invention is to couple at least two individual lattice boom cranes, which are actually designed for the lifting of less heavy loads, for the lifting of very heavy loads in the above-described manner. Because at least two individual cranes are releasably coupled to one unit according to the invention, only minor modifications to the individual lattice boom cranes are necessary in order to now be able to increase the loading capacity of an individual lattice boom crane so as to lift exceedingly heavy loads. At the same time, it is also possible to continue to use the individual lattice boom cranes for their originally intended purpose. This modular concept requires no disproportionately high reconstruction and also further allows the economical use of the individual lattice boom cranes in the use domains originally intended for them. In particular, it is possible with fewer additional parts and thus costs to combine the load capacities of the individual lattice boom cranes, so that even greater loads can be lifted than the sum of the individual loads of the individual cranes.

A further exemplary embodiment of the present invention comprises two or more base cranes disposed in parallel and adjacent to each other, which base cranes are connected to at least one base crane component in order to ensure an exact positioning of the individual cranes with respect to each other. For example, the base cranes can be connected with each other at a portion of the lower chassis, at a portion of the upper chassis or at a portion of the rotary joint. The base cranes can, for example, be rigidly and mechanically connected to each other by one or more rods, connection supports or the like. It is also possible, e.g., to rigidly connect crawler carriers of the lower chassis at one or more positions. A further alternative can consist in that the two adjacent base cranes are connected with each other by a common crawler carrier. The cranes could thereby stand closer together.

In the alternative to a mechanical connection of the base cranes, it can also be provided that a controller with a corresponding measuring device is present, which measuring device monitors the position of the base cranes with respect to each other and, if necessary, controls the drives of the base cranes, so that they remain oriented in parallel and adjacent to each other. In case the positional deviation nevertheless increases over a certain amount, the controller automatically shuts down the crane in order to prevent an unsafe state.

By the optimal construction with crawler devices, traversing with very heavy loads is possible with an inventive lattice boom crane, whereby the working domain of the crane is enlarged. In contrast to the above-noted prior art, a large working domain is provided with such an advantageous exemplary embodiment of an inventive lattice boom crane, although the rotatable upper chassis can no longer rotate due to the rigid connection of the lattice booms.

An exemplary embodiment of the present invention envisions that the individual lattice boom cranes each comprise a lower chassis with laterally-affixed crawlers. The individual cranes are situated next to each other, so that the crawlers are oriented in parallel. The right crawler of the left crane is connected with the left crawler of the right crane. Further, the booms of the individual cranes are connected with each other. Rotation of the individual cranes is thus no longer possible. Nevertheless, the entire crane can proceed forwards and navigate curves to a limited extent, whereby rotation of the entire crane can be achieved.

A further alternative exemplary embodiment of the present invention can envision that the crawlers are not disposed in parallel, but rather are disposed in series, in order to facilitate procession in the traverse direction. In this case, the connection of the individual cranes can be made via the crawlers or the two lower chassis. A connection of the crawlers is especially advantageous when the crawlers are separated in the middle in some way, such as is already customary for large equipment due to transport-logistical reasons. An adapter piece can then be mounted between two crawler halves, wherein the track runs around all three parts.

Still another exemplary embodiment of the present invention envisions that the two lower chassis are rigidly connected to each other and at least one crawler is disposed on each outer-lying side of the two lower chassis. The crane is thus very capable of rotating about a point. Proceeding to the side or in the longitudinal direction is only possible in a severely limited manner, but can be made easier by lifting a pair of opposing crawlers from the ground.

The main function of each connection consists in that the position of the individual cranes with respect to each other is secured. This can also take place by a connection element that connects the upper chassis with each other. This would have the advantage that the rotary joint of the individual cranes can be further used in order to orient the crawlers either in the longitudinal or traverse directions and/or in intermediate positions. The connection of the connecting elements with the upper chassis can be made, e.g., by means of bolt or screw-fastening. In addition, a quick connection can be advantageously used, such as the one described in DE 19549244C2.

Further, in all of the above-mentioned exemplary embodiments of the present invention, the rotation and procession of the load is at least restrictively possible by moving the crawler units in the same or opposite directions, which leads in the latter case to a rotation of the lattice boom crane joined to a unit.

An advantageous exemplary embodiment of the present invention envisions that the crane controllers are connected. It is appropriate to synchronize and/or coordinate the operation and/or proceeding of the lifting devices, the tilting or luffing mechanisms and the crawler drives, so that the function and safety of the crane can be ensured. This can take place by communication between the controllers or by a controller that is connected to the individual controllers in a master-slave arrangement. The master controller can be controlled within one of the two cranes or outside the cranes. In the alternative or in addition to a synchronization of the drives via the controller, a mechanical or hydraulic coupling can also take place.

It is noted that according to another aspect of the present invention, in the case of the manufacturing of a connection of the crane controllers of the two or more individual cranes, a mechanical connection of the lattice booms of the individual cranes can be foregone, if need be; however, conditions should then be that a synchronized tilting or luffing of the lattice booms and/or a synchronized procession and/or movement of the base cranes is ensured by the communication of the individual controllers. Such an inventive lattice boom crane can thus comprise at least two individual lattice boom cranes that each comprise a base crane having an upper chassis, on which a tiltable or luffing lattice boom is disposed; the tilting or luffing angle of the lattice boom is adjustable via tilting or luffing mechanism. A control device for controlling all tilting or luffing mechanisms of the individual lattice boom cranes is provided. According to this further exemplary embodiment of the present invention, the lattice booms are oriented in parallel and adjacent to each other and the tilting or luffing mechanisms of the individual lattice boom cranes are controllable by the control device, such that the at least two lattice booms are synchronously tiltable or can be synchronously luffed.

A further exemplary embodiment of the present invention according to the above-mentioned aspect includes that the control device for controlling all tilting mechanisms of the individual lattice boom cranes is connected to the respective controllers of the individual lattice boom cranes in a master-slave arrangement.

A further exemplary embodiment of the present invention according to the above-mentioned aspect envisions that the control device, which is connected to the respective controllers of the individual lattice boom cranes in the master-slave arrangement, is also designed for the synchronous controlling of the base cranes, so that asynchronous procession or movement of the lower chassis of the individual lattice boom cranes is ensured.

In addition, in a further exemplary embodiment of the present invention according to the above-mentioned aspect, the lattice booms, which are oriented in parallel and adjacent to each other, can be rigidly connected with each other to a boom unit, whereby the booms are united such that a still stronger boom unit is formed and thus heavier loads can be lifted. In a lattice boom crane according to the first aspect as well as to the second aspect, the connection can be made by one or more connection elements, such as, e.g., rods, pipes or lattice connection elements at one or more positions. The latter can be designed as lattice boom pieces. The connection can be made, e.g., by bolt-fastening.

For the purpose of a comprehensive discussion, it is noted that individual features of the exemplary embodiments and aspects described herein can be combined with other features of other exemplary embodiments and aspects. Moreover, connections between booms, crawler carriers, and lower or upper chassis could be designed as releasable connections. It is also implicitly possible to manufacture all or only certain connections with durable connections such as welds or the like. However, in certain circumstances, such connections could be again destroyed after the use of a lattice boom crane formed from multiple individual lattice boom cranes. In the present application, the term "connection" encompasses non-destructive releasable connections, as well as connections that are releasable only by destruction.

BRIEF DESCRIPTION OF THE DRAWINGS

In the following, several exemplary embodiments of the present invention are described in greater detail with reference to the attached drawings for further explanation and better understanding.

DETAILED DESCRIPTION OF THE INVENTION

Figure 1:
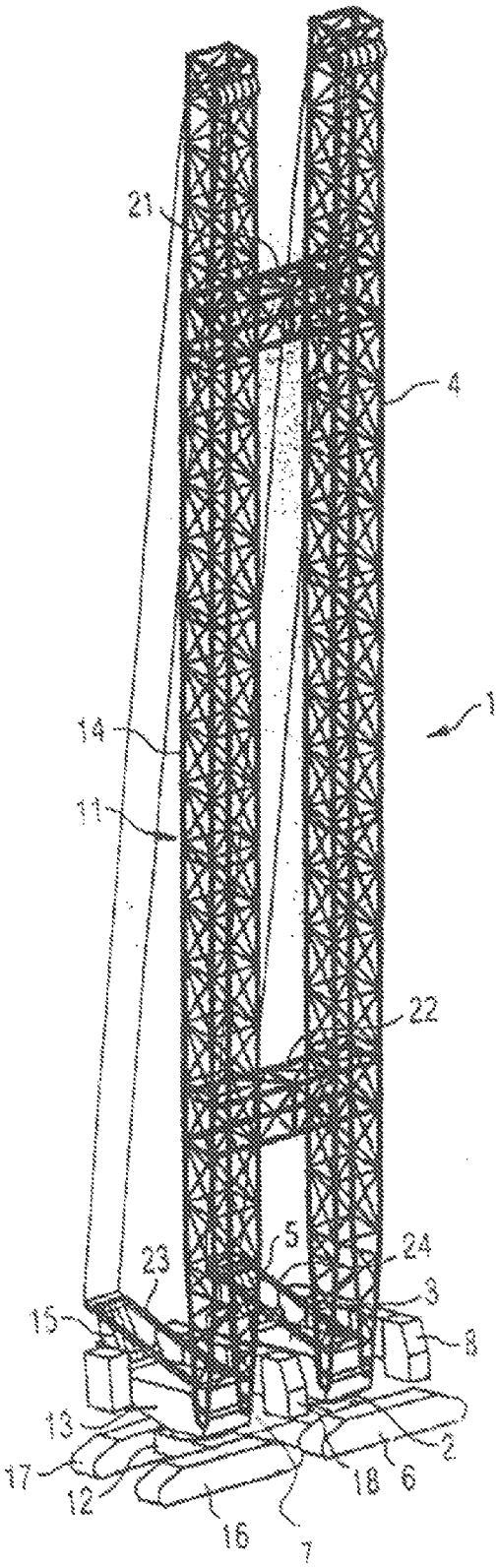
FIG. 1 is a perspective view showing an inventive lattice boom crane that comprises two individual lattice boom cranes.

In FIG. 1, a first exemplary embodiment of an inventive lattice boom crane with a crawler mechanism is shown in perspective illustration. In this exemplary embodiment, the inventive lattice boom crane comprises two individual lattice boom cranes 1, 11, each of which comprises a lower chassis 2, 12 and an upper chassis rotatably disposed thereon. A lattice boom 4, 14 is tiltably affixed on each respective upper chassis 3, 13. The tilting angle of the two lattice booms 4, 14 is adjustable by a tilting mechanism 5, 15, respectively, which are only schematically illustrated herein. The tilting mechanisms 5, 15 comprise not shown tilting winches, on each of which a cable is wound; the cables are respectively affixed to each scaffold trestle 23, 24. By winding and unwinding of the two cables, each respective tilt angle is adjustable. Due to the fact that the tilting mechanisms 5, 15 are synchronized according to the present invention, which synchronization can take place in an electronic manner or by mechanical coupling of the winches, the tilting of the lattice booms 4, 14 takes place synchronously.

As shown in FIG. 1, the two lattice booms are rigidly connected with each other by lattice connection elements 21, 22. In the exemplary embodiment of the present invention shown herein, a first lattice boom connection element 21 is affixed in the upper third of the two lattice booms 4, 14. A further lattice boom connection element 22 is provided in the lower third of the two lattice booms 4, 14. In order to improve stiffness, it is also naturally possible to provide further lattice boom connection elements in further sections of the two lattice booms 4, 14. By this rigid coupling of the two lattice booms 4, 14, the loading capacity is, if necessary, even higher than the sum of the individual ultimate loads.

As is apparent in FIG. 1, according to this exemplary embodiment, the two lower chassis 2, 12 of the individual lattice boom cranes are disposed adjacent to each other and each comprise its own crawler 6, 7 and 16, 17, respectively. Preferably, the two lower chassis in this arrangement are likewise rigidly connected with each other by connection elements in order to prevent a relative movement between the two lower chassis 2, 12 when the crawlers 6, 7 and 16, 17, respectively, are actuated. In this exemplary embodiment of the present invention, the newly formed lattice boom crane can be controlled by an operator's stand 8 or 18. For this purpose, the one controller of the one crane is designed as a slave with respect to the master of the other crane. The coupling of the two controllers is made by a cable that is not illustrated herein. It is to be noted that the coupling of the two controllers comprises, in particular, the coupling of the tilting mechanisms 5, 15. However, it is also possible to electronically couple the drives of the crawlers 6, 7 and 16, 17 in the required manner, so that the operation of the crawlers 6, 7 and 16, 17 will be controlled, so that a procession and/or rotation of the lattice boom crane is possible, but the actuation elements, which are necessary therefor, are only actuated in one operator's stand 18 or 8. The same applies then also for the cable hoisting actuation device and its actuation, which are not shown herein.

Figure 2:
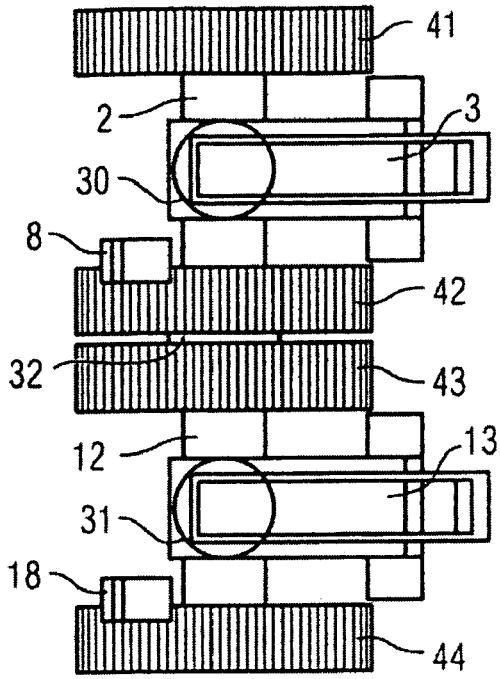
FIG. 2 is a schematic top view of an inventive lattice boom crane showing two lower chassis coupled with each other and having parallel-connected crawlers.

In FIG. 2, an alternative exemplary embodiment of the coupling of two lower chassis 2, 12 of an inventive lattice boom crane is shown. Here, the crawlers 41, 42 of the one lower chassis 2 and the crawlers 43, 44 of the other lower chassis 12 are not connected in series like in FIG. 1, but rather are disposed in parallel. The two crawlers 42, 43, which face each other in this configuration, are coupled with each other by a connection element 32. Thus, this connection element 32 also creates a connection of the two lower chassis 2, 12. It is to be noted that the rim bearings 30, 31, respectively, of the two upper chassis 3, 13 are indicated herein.

According to the exemplary embodiment of the present invention shown in FIG. 2, the crawlers 41-44 can be simultaneously moved in order to laterally traverse the lattice boom crane according to the present invention. When the crawlers 41, 42 move in the opposite direction with respect to the crawlers 43, 44, a rotation of the individual lattice boom cranes, which are coupled with each other, can take place despite the rigid connection of the two lattice booms 4, 14 shown in FIG. 1.

Figure 3:
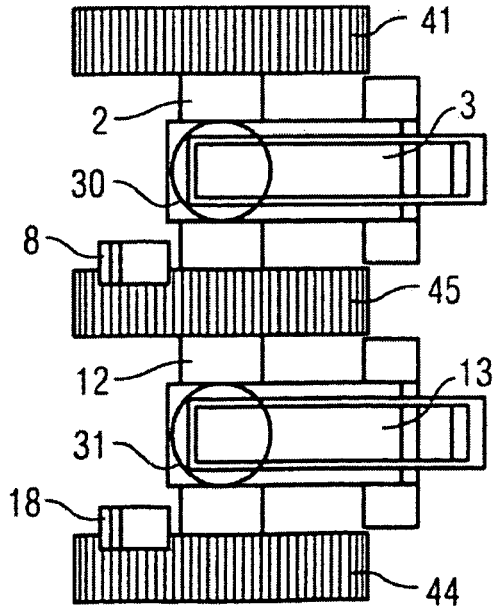
FIG. 3 shows a schematic top view of an inventive lattice boom crane showing two lower chassis coupled with each other, wherein the two lower chassis are coupled with each other by a common crawler.

In FIG. 3, a modified exemplary embodiment of the parallel arrangement of two lower chassis 2, 12 with respect to FIG. 2 is shown. Here, only three crawlers 41, 44, 45 are provided. With respect to the exemplary embodiment of the present invention shown in FIG. 2, the crawlers 42, 43 are combined into one crawler 45. As a result, the individual cranes stand close together and the carrier of one crawler is omitted.

Figure 4:
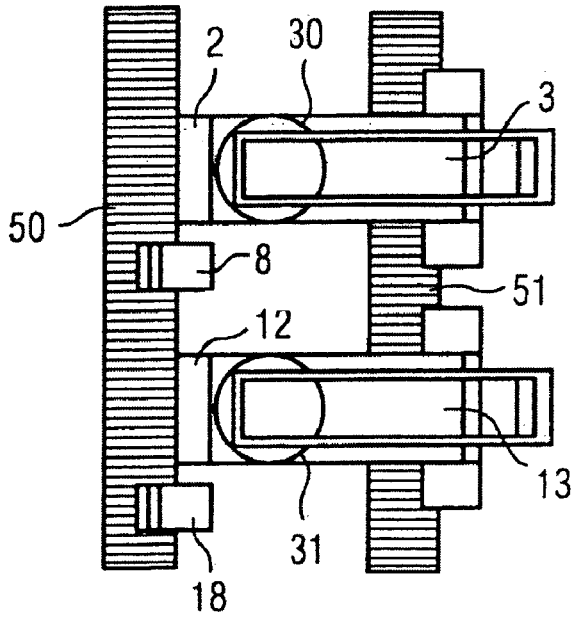
FIG. 4 is a schematic top view of an inventive lattice boom crane showing two lower chassis having crawlers connected in series.

FIG. 4 shows a further modified exemplary embodiment of the present invention, which was already described in a similar manner in the exemplary embodiment of FIG. 1. According to the top view shown herein of two lower chassis 2, 12, which are disposed in parallel and adjacent to each other, the crawlers are connected in series similar to FIG. 1. However, the individual crawlers 6, 16 and 7, 17, respectively, which are shown in FIG. 1, are combined into one crawler 50, 51, respectively.

Figure 5:
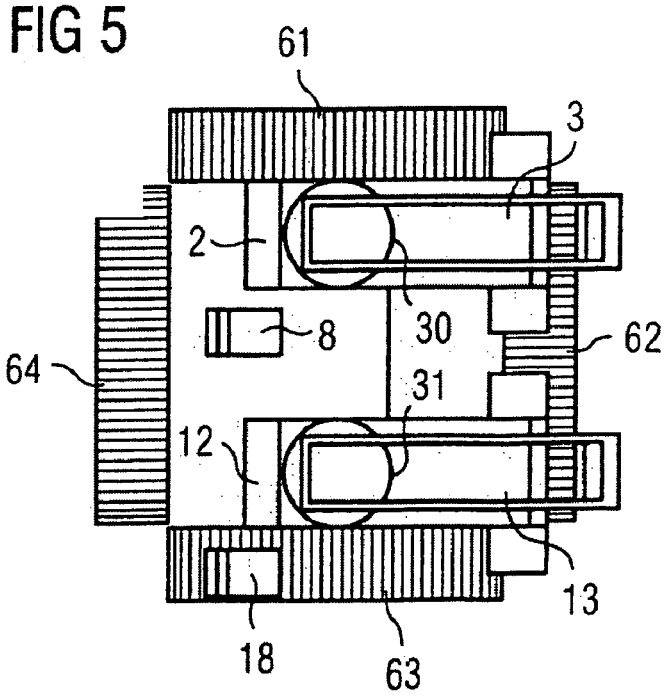
FIG. 5 is a schematic top view showing another exemplary embodiment of an inventive crane with adjacently disposed lower chassis and crawlers, which are disposed on the outer sides of the coupled-together lower chassis.

A last exemplary embodiment of the present invention is shown in top view in FIG. 5. Here, the two lower chassis 2, 12 are again rigidly coupled with each other. Crawlers 61-64 are affixed on each outer side of the lower chassis that are rigidly coupled with each other. By this "quadratic" arrangement, at least a rotation of the coupled-together lower chassis 2, 12 can be made possible. A procession to the side or in the longitudinal direction is only possible with severe limitations, but can be made easier by lifting opposing crawlers from the ground.

Figure 6A:
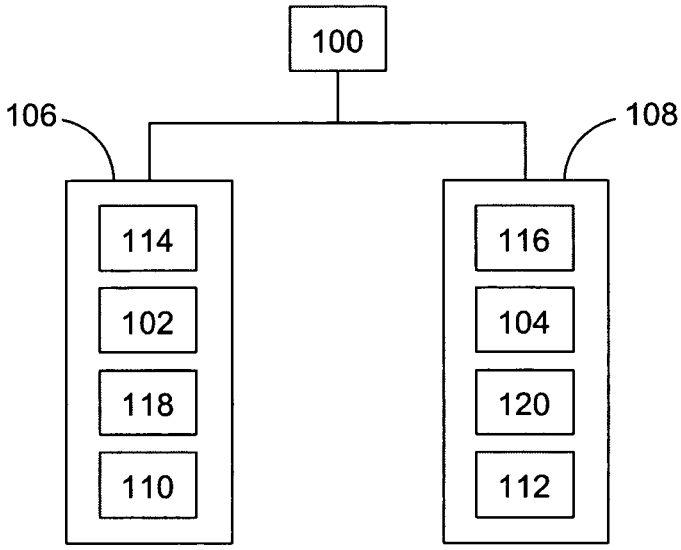
FIGS. 6A-6C are schematic block diagrams of present invention controller arrangements; and, FIG. 7 is a schematic block diagram showing connection of slewing platforms and synchronization of winches in inventive lattice boom cranes.
Figure 6B:
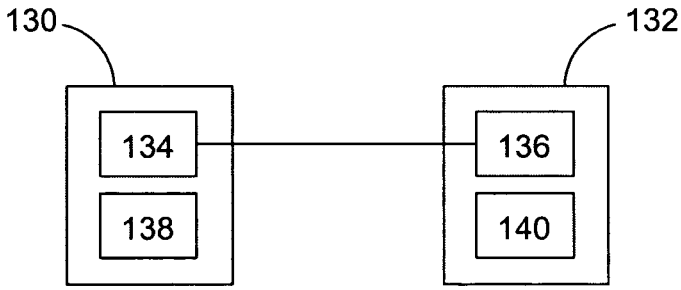
Figure 6C:
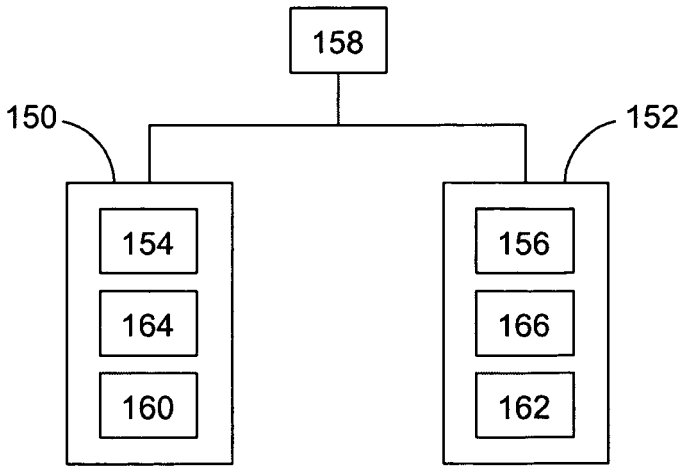

FIGS. 6A-6C are schematic block diagrams of present invention controller arrangements. In FIGS. 6A-6C, two cranes are shown, however, it should be understood that the present invention is not limited to two cranes. In FIG. 6A, controller 100 is connected to luffing mechanisms 102 and 104 in cranes 106 and 108, respectively. Luffing mechanisms 102 and 104 are controllable by control device 100 such that lattice booms 110 and 112, of cranes 106 and 108, respectively, are synchronously luffable. In one embodiment, cranes 106 and 108 include controllers 114 and 116, respectively. Controller 100 is connected to controllers 114 and 116 in a master-slave arrangement. In another embodiment, controller 100 is designed for synchronously controlling base cranes 118 and 120 for lattice boom cranes 106 and 108, respectively. In FIG. 6B, cranes 130 and 132 include controllers 134 and 136, respectively. Controller 134 is connected to controller 136 in a master-slave relationship such that synchronous luffing of booms 138 and 140 is ensured. In FIG. 6C, cranes 150 and 152 include controllers 154 and 156, respectively. Controller 158 is connected to controllers 154 and 156 in a master-slave arrangement. In one embodiment, controller 158 ensures a synchronous luffing of lattice booms 160 and 162. In another embodiment, controller 158 monitors the relative positions of base cranes 164 and 166 with respect to each other and, if necessary, corrects the respective positions with respect to each other.

Figure 7:
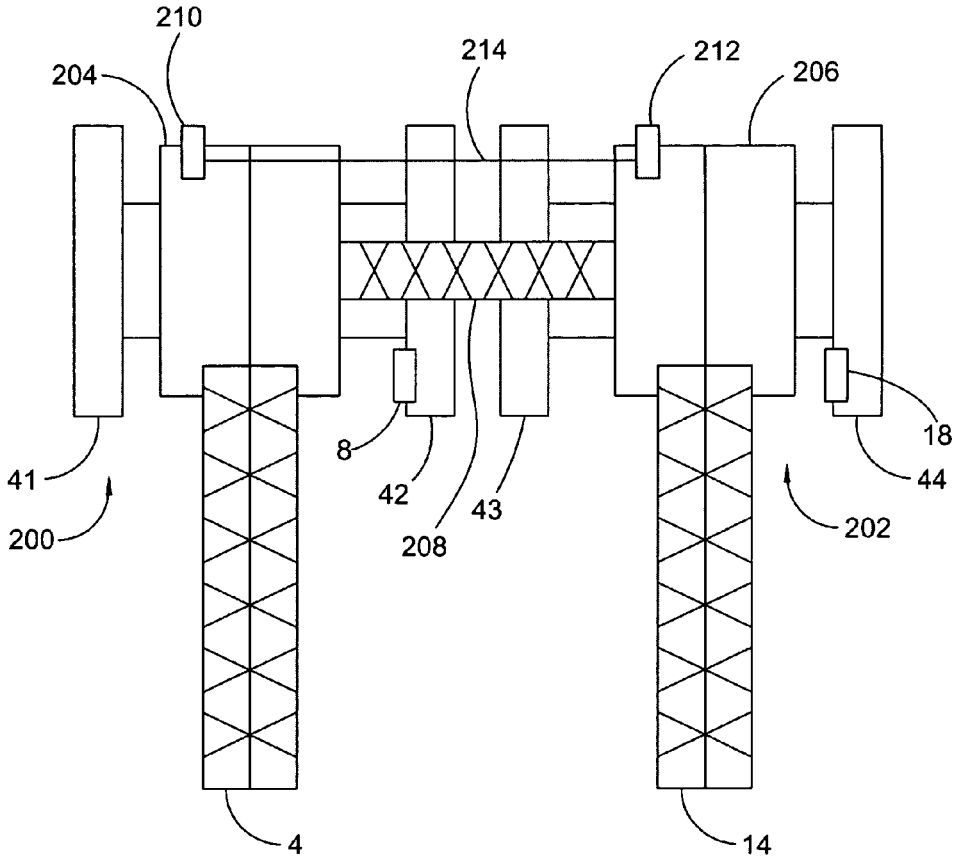

FIG. 7 is a schematic block diagram showing connection of slewing platforms and synchronization of winches in inventive lattice boom cranes. Cranes 200 and 202 include slewing platforms 204 and 206, respectively, joined by connector 208. In addition, winches 210 and 212 are synchronized as shown by mechanical synchronization 214. It should be understood that cranes 200 and 202 do not necessarily include both connector 208 and mechanical synchronization 214. For example, in one embodiment, cranes 200 and 202 include only one of connector 208 or mechanical synchronization 214.

For the purpose of a comprehensive discussion, it is noted that for all the above-mentioned exemplary embodiment examples of the present invention, the mounting of the releasable crawlers on the respective lower chassis is achievable, e.g., by hydraulic bolts, as is already known per se with the individual cranes.

By the present invention, the usability of the individual cranes is, in particular, not so affected, in particular its constructions are also not to be, or only negligibly, modified in view of a possible coupling with a further crane. The consolidation of multiple individual lattice boom cranes can be accomplished by utilizing the former properties and the crawler configuration of the individual cranes. Consequently, the lifting of very heavy loads is also economically possible with minimal modifications and thus is quite cost-effective, because for the first time the usability of such crawler lattice boom cranes as individual cranes remains possible.

What is claimed is:

1. A lattice boom crane, comprising:

a first individual lattice boom crane having a first undercarriage, a first slewing platform, a first lattice boom and a first luffing mechanism for luffing the first lattice boom, wherein the first slewing platform is affixed on the first undercarriage and the first luffing lattice boom is disposed on the first slewing platform and wherein the luffing angle of the first lattice boom is adjustable by the first luffing mechanism; and, at least one second individual lattice boom crane having a second undercarriage, a second slewing platform, a second lattice boom and a second luffing mechanism for luffing the second lattice boom, wherein the second slewing platform is affixed on the second undercarriage and the second luffing lattice boom is disposed on the second slewing platform and wherein the luffing angle of the second lattice boom is adjustable by the second luffing mechanism;

wherein adjacent respective lattice booms of the first and at least one second individual lattice boom cranes are oriented in parallel and rigidly connected with each other using a respective connection support such that a substantially fixed angle is maintained between the respective connection support and the adjacent respective lattice booms, wherein respective luffing mechanisms of the first and the at least one second lattice boom cranes are synchronously operated such that the first and the at least one second lattice booms can synchronously be luffed, wherein the first lattice boom crane includes a first pair of crawlers, wherein each lattice boom crane among the at least one second lattice boom crane includes a respective second pair of crawlers, wherein respective undercarriages of the first and at least one second lattice boom cranes are oriented in parallel in a first direction and adjacent to each other, wherein the first pair of crawlers is disposed in series with the respective second pair of crawlers in a second direction substantially orthogonal to the first direction, wherein the first pair of crawlers includes first and second individual crawlers, wherein the respective second pair of crawlers includes third and fourth individual crawlers, and wherein the first and third individual crawlers are combined into a first common crawler and the second and fourth individual crawlers are combined into a second common crawler.

2. The lattice boom crane according to claim 1, wherein the first and at least one second lattice boom cranes are additionally rigidly connected with each other at least one base crane component in order to prevent a relative movement between the base crane components.

3. The lattice boom crane according to claim 1, wherein a controller is provided that monitors relative positions of respective base cranes for the first and at least one second lattice boom cranes with respect to each other and, if necessary, corrects the relative positions with respect to each other or potentially prohibits a crane operation when the respective positions of the base cranes deviate too severely from each other.

4. The lattice boom crane according to claim 1, wherein the respective luffing mechanisms each comprise a respective winch and the respective winches are electronically synchronized with each other.

5. The lattice boom crane according to claim 1, wherein on each undercarriage of the first and at least one second lattice boom cranes respective lateral crawlers are releasably affixed, and the undercarriages are rigidly connected with each other.

6. A lattice boom crane, comprising:

a first individual lattice boom crane having a first undercarriage, a first slewing platform, a first lattice boom and a first luffing mechanism for luffing the first lattice boom, wherein the first slewing platform is affixed on the first undercarriage and the first luffing lattice boom is disposed on the first slewing platform and wherein the luffing angle of the first lattice boom is adjustable by the first luffing mechanism; and, at least one second individual lattice boom crane having a second undercarriage, a second slewing platform, a second lattice boom and a second luffing mechanism for luffing the second lattice boom, wherein the second slewing platform is affixed on the second undercarriage and the second luffing lattice boom is disposed on the second slewing platform and wherein the luffing angle of the second lattice boom is adjustable by the second luffing mechanism, wherein adjacent respective lattice booms of the first and at least one second individual lattice boom cranes are oriented in parallel and rigidly connected with each other using a respective connection support such that a substantially fixed angle is maintained between the respective connection support and the adjacent respective lattice booms; and, wherein the respective luffing mechanisms of the first and the at least one second lattice boom cranes are synchronously operated such that the first and the at least second lattice booms can synchronously be luffed, the lattice boom crane further including first and second crawlers, wherein respective undercarriages of the first and at least one second lattice boom cranes are connected with each other, wherein the first lattice boom crane includes a third crawler, wherein the at least one second lattice boom crane includes a second lattice boom crane with a fourth crawler, wherein the first and second crawlers are disposed on first and second outer sides of the connected-together respective undercarriages, and wherein the third and fourth crawlers are disposed on third and fourth outer sides of the connected-together respective undercarriages.

7. A lattice boom crane, comprising:

at least two individual lattice boom cranes, each comprising a respective base crane having a slewing upper chassis, on which a luffing lattice boom is disposed, whose luffing angle is adjustable by a luffing mechanism; and, a first control device for controlling respective luffing mechanisms of the at least two lattice boom cranes, wherein respective lattice booms for the at least two lattice boom cranes are oriented in parallel wherein adjacent respective lattice booms are rigidly connected, and wherein the respective luffing mechanisms are controllable by the first control device such that the at least two lattice booms are synchronously luffable, wherein each lattice boom crane among the at least two lattice boom cranes includes a respective pair of crawlers, wherein respective undercarriages of the at least two second lattice boom cranes are oriented in parallel and adjacent to each other, and wherein the respective pairs of crawlers are disposed in series, wherein the respective pairs of crawlers includes first and second individual crawlers, and wherein the first individual crawlers are combined into a first common crawler and the second individual crawlers are combined into a second common crawler.

8. The lattice boom crane according to claim 7, wherein the respective lattice booms of the at least two lattice boom cranes are rigidly connected with each other to a boom unit.

9. The lattice boom crane according to claim 7, wherein the at least two lattice boom cranes each comprise a respective undercarriage, on which respective undercarriage respective lateral crawlers are releasably affixed, and the respective undercarriages are rigidly connected with each other.

10. The lattice boom crane according to claim 7, wherein a rigid connection between respective slewing upper chassis, as well as between respective undercarriages, of the at least two lattice boom cranes is provided.

11. A lattice boom crane, comprising:

at least two individual lattice boom cranes, each individual lattice boom crane comprising a respective base crane having a slewing upper chassis, on which a luffing lattice boom is disposed, whose luffing angle is adjustable by a luffing mechanism; and, a first control device for controlling respective luffing mechanisms of the at least two lattice boom cranes, wherein respective lattice booms for the at least two lattice boom cranes are oriented in parallel, wherein adjacent respective lattice booms are rigidly connected, and wherein the respective luffing mechanisms are controllable by the first control device such that the at least two lattice booms are synchronously luffable, said lattice boom crane further including first and second crawlers, wherein respective undercarriages of the at least two second lattice boom cranes are connected with each other, wherein each lattice boom crane among the at least two lattice boom cranes includes respective third and fourth crawlers, wherein the first and second crawlers are disposed on first and second outer sides of the connected-together respective undercarriages, and wherein the third and fourth crawlers are disposed on third and fourth outer sides of the connected-together respective undercarriages, respectively.

* * * * *